US009587897B1

(12) United States Patent
Huang et al.

(10) Patent No.: US 9,587,897 B1
(45) Date of Patent: Mar. 7, 2017

(54) INTERCHANGEABLE SAFETY SELECTOR FOR FIREARMS

(71) Applicants: George Huang, Henderson, NV (US); Roger Wang, Malibu, CA (US)

(72) Inventors: George Huang, Henderson, NV (US); Roger Wang, Malibu, CA (US)

( * ) Notice: Subject to any disclaimer, the term of this patent is extended or adjusted under 35 U.S.C. 154(b) by 0 days.

(21) Appl. No.: 14/327,282

(22) Filed: Jul. 9, 2014

Related U.S. Application Data

(63) Continuation-in-part of application No. 13/068,287, filed on May 7, 2011, now Pat. No. 8,806,790.

(60) Provisional application No. 61/338,541, filed on Feb. 19, 2010, provisional application No. 61/400,643, filed on Jul. 31, 2010.

(51) Int. Cl.

| | |
|---|---|
| ***F41A 17/70*** | (2006.01) |
| ***F41A 17/00*** | (2006.01) |
| ***F41A 17/62*** | (2006.01) |
| ***F41A 17/56*** | (2006.01) |

(52) U.S. Cl.
CPC ..... *F41A 17/00* (2013.01); *F41A 17/56* (2013.01); *F41A 17/62* (2013.01); *F41A 17/70* (2013.01)

(58) Field of Classification Search
CPC ..... F41A 17/64; F41A 17/70; F41A 17/74; F41A 17/80; F41A 17/46; F41A 17/52; F41A 17/56; F41A 17/62
USPC ..... 42/70.06, 70.08
See application file for complete search history.

(56) References Cited

U.S. PATENT DOCUMENTS

| | | | | |
|---|---|---|---|---|
| 4,414,769 | A * | 11/1983 | Mueschke | 42/70.01 |
| 4,422,254 | A * | 12/1983 | McQueen | 42/70.07 |
| 4,667,429 | A * | 5/1987 | Perazzi | F41A 19/16 42/69.01 |
| 6,305,114 | B1 * | 10/2001 | Saltz | 42/70.08 |
| 8,276,502 | B1 * | 10/2012 | Wright | 89/148 |
| 2005/0229462 | A1 * | 10/2005 | McGarry | 42/70.08 |

FOREIGN PATENT DOCUMENTS

EP 0529871 * 3/1993

* cited by examiner

*Primary Examiner* — Stephen M Johnson
(74) *Attorney, Agent, or Firm* — Shaddock Law Group, PC

(57) ABSTRACT

An interchangeable safety selector that includes a generally cylindrical lock member rotatable between a safe and a fire position, wherein when the lock member is in the safe position a first portion of the lock member blocks movement of a portion of a firing mechanism of a firearm; a projection formed on each end of the lock member; and at least two lever members, each lever member having a recess mateable with the projection of the lock member, wherein the lever members are interchangeable, wherein one of the lever members is secured to a first end of the lock member via interaction of the projection and the recess and is further secured to the first end of the lock member via a screw.

18 Claims, 26 Drawing Sheets

INTERCHANGEABLE SAFETY SELECTOR FOR FIREARMS

CROSS-REFERENCE TO RELATED APPLICATIONS

This patent application is a Continuation-In-Part of U.S. patent application Ser. No. 13/068,287, filed May 7, 2011, now U.S. Pat. No. 8,806,790, which claims the benefit of U.S. Patent Application Ser. No. 61/338,541, filed Feb. 19, 2010, and U.S. Patent Application Ser. No. 61/400,643, filed Jul. 31, 2010, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms and is particularly directed to improved interchangeable safety selectors for firearms, such as the AR-15, M4, and the like.

2. Description of Related Art

It is well known that most modern firearms are provided with a safety selector, which includes a lock member mounted within a portion of the firearm and movable between a "SAFE" position, in which the lock member blocks movement of a portion of the firearm's firing mechanism, such as the trigger or the hammer, and a "FIRE" position, which allows firing of the firearm. The lock member is actuated by a safety selector, mounted on the outside of the firearm, and connected to the lock member to move the lock member between the "SAFE" and "FIRE" positions. As manufactured, modern firearms are provided with a safety selector on the right side of the firearm, since most people are right-handed.

However, this is extremely inconvenient for left-handed people to operate. Also, the standard size of the safety selector lever for the AR-15 or M4 style firearm is about one inch in length and about ¼ inch in width and thickness. While this size makes the safety selector lever easy to locate and move, it, unfortunately, makes it very easy for the selector lever to catch the web of skin between the user's thumb and forefinger, which is painful and can interfere with actuation of the selector lever. Also, due to the size and bulk of the safety selector lever, many right-handed users find it annoying, since it underlies the trigger finger and can be uncomfortable.

Modifications have been proposed for replacing the manufacturer's safety mechanism with an interchangeable device having safety levers provided on both sides of the firearm to accommodate both left- and right-handed people. However, while certain modifications of the prior art provide safety selectors levers on both sides of the firearm, the modified safety levers are of the same dimensions as the manufacturer's safety selector levers. This merely multiplies the disadvantages mentioned above.

It has also been proposed to provide a shortened safety selector lever of approximately ½ inch. This reduces the likelihood of catching the user's skin, but does little to improve the bulkiness of the safety selector lever. Thus, none of the prior art safety selectors levers have been entirely satisfactory.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF INVENTION

These disadvantages of the prior art are overcome with the present invention and interchangeable safety selector levers are provided, which allow the user to choose a safety selector lever that they feel is comfortable and convenient, yet is easy to identify and use.

These advantages of the present invention are preferably attained by providing a plurality of ambidextrous, interchangeable safety selector levers in a variety of lengths and thicknesses, which allow the user to select and install the ones that they feel are most desirable.

In various exemplary, non-limiting embodiments, the present invention comprises an interchangeable safety selector having a generally cylindrical lock member rotatable between a safe and a fire position, wherein when the lock member is in the safe position a first portion of the lock member blocks movement of a portion of a firing mechanism of a firearm; a projection formed on each end of the lock member; and at least two lever members, each lever member having a recess mateable with the projection of the lock member, wherein the lever members are interchangeable, wherein one of the lever members is secured to a first end of the lock member via interaction of the projection and the recess and is further secured to the first end of the lock member via a screw.

In certain exemplary embodiments, the safety selector further includes a detent recess formed in the lock member, wherein the detent recess restricts rotational movement of the lock member to 50°.

In other exemplary, non-limiting embodiments, the present invention comprises an interchangeable safety selector having a generally cylindrical lock member rotatable between a safe and a fire position, wherein when the lock member is in the safe position a first portion of the lock member blocks movement of a portion of a firing mechanism of a firearm; a dovetail projection formed on each end of the lock member; and at least two lever members, each lever member having a recess mateable with the dovetail projection of the lock member, wherein the lever members are interchangeable, wherein one of the lever members is secured to a first end of the lock member via interaction of the dovetail projection and the recess and is further secured to the first end of the lock member via a screw.

In still other exemplary, non-limiting embodiments, the present invention comprises an interchangeable safety selector having a generally cylindrical lock member rotatable between a safe and a fire position, wherein when the lock member is in the safe position a first portion of the lock member blocks movement of a portion of a firing mechanism of a firearm; a first projection formed on a first end of the lock member, wherein the first projection defines a recess in the first end of the lock member; a second projection formed on a second end of the lock member, wherein the second projection defines a recess in the second end of the lock member; and at least two lever members, each lever member having a lever projection mateable with each of the recesses of the lock member, wherein a first lever member is secured to the first end of the lock member via interaction of the recess in the first end of the lock member and the lever projection and is further secured to the first end of the lock member via a screw, and wherein a second lever member is secured to the second end of the lock member via interaction of the recess in the second end of the lock member and the lever projection and is further secured to the second end of the lock member via a screw.

Accordingly, the presently disclosed invention separately provides improved safety selectors for firearms.

The presently disclosed invention separately provides improved safety selectors for firearms, which selectors are interchangeable.

The presently disclosed invention separately provides improved safety selectors for firearms, which selectors are ambidextrous and interchangeable.

The presently disclosed invention separately provides improved safety selector levers for firearms, which selector levers are interchangeable and come in a plurality of interchangeable sizes to enable the user to select those that they feel are most desirable.

The presently disclosed invention separately provides improved safety selector levers for firearms, which selector levers are interchangeable and come in a plurality of interchangeable lengths and thicknesses to enable the user to select those that they feel are most desirable.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
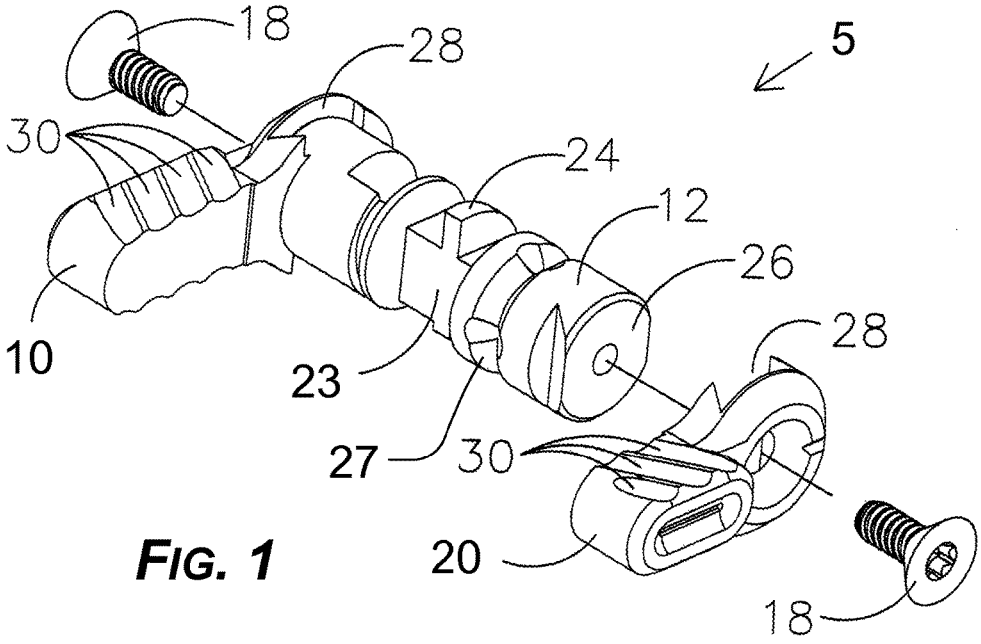
FIG. 1 illustrates an exploded view of a safety selector according to an exemplary embodiment of the present invention.

For simplicity and clarification, the design factors and operating principles of the interchangeable safety selector levers according to this invention are explained with reference to various exemplary embodiments of an interchangeable safety selector levers according to this invention. The basic explanation of the design factors and operating principles of the interchangeable safety selector levers is applicable for the understanding, design, and operation of the interchangeable safety selector levers of this invention. It should be appreciated that the interchangeable safety selector levers can be adapted to many applications where a safety selector lever is necessary or desirable.

It should also be appreciated that the terms "safety selector", "selector", "lever", and "firearm" are used for basic explanation and understanding of the operation of the systems, methods, and apparatuses of this invention. Therefore, the terms "safety selector", "selector", "lever", and "firearm" are not to be construed as limiting the systems, methods, and apparatuses of this invention.

For simplicity and clarification, the interchangeable safety selector levers of this invention will be described as being used as a safety selector lever for an AR-15 or M4 style firearm. However, it should be appreciated that these are merely exemplary embodiments of the interchangeable safety selector levers and are not to be construed as limiting this invention. Thus, the interchangeable safety selector levers of this invention may be utilized in connection with any firearm or other device using a safety selector lever.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Turning now to the drawing FIGS., FIGS. 1-15 illustrate certain elements and/or aspects of a first exemplary embodiment of the interchangeable safety selector 5, according to this invention. In illustrative, non-limiting embodiment(s) of this invention, as illustrated in FIGS. 1-15, the interchangeable safety selector 5 comprise at least some of a lock member 12 and lever members 10, 20, and/or 30.

Figure 2:
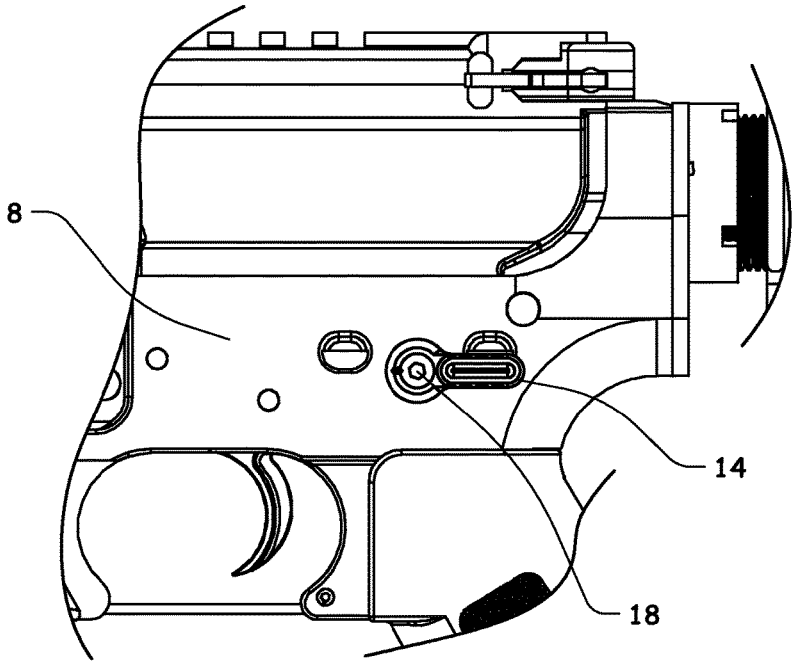
FIG. 2 illustrates a side view of a portion of an exemplary AR-15 or M4 style firearm showing an exemplary safety selector of the present invention in the "SAFE" position.
Figure 3:
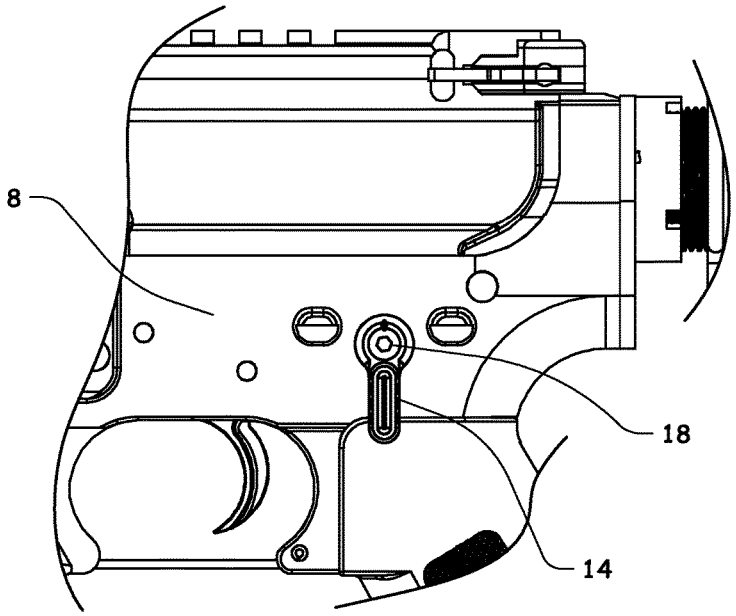
FIG. 3 illustrates a side view of a portion of an exemplary AR-15 or M4 style firearm showing an exemplary safety selector of the present invention in the "FIRE" position.

In the form of the present invention chosen for purposes of illustration, FIG. 1 shows an exploded view of the interchangeable safety selector 5 removed from a firearm and comprising a lock member 12 and a pair of lever members 10 and 30 secured to opposing ends of the lock member 12 by suitable means, such as, for example, screws 18. The lock member 12 is formed with a first portion 24 and a central recess 23. The safety selector 5 is mounted in a firearm 8, as seen in FIG. 2, and is rotatable between a "SAFE" position, as shown in FIG. 2, and a "FIRE" position, as shown in FIG. 3.

When the safety selector 5 is in the "SAFE" position, the first portion 24 of the lock member protrudes into the path of a movable member of the firearm's firing mechanism, such as a portion of the trigger or the hammer, not shown. However, when the safety selector 5 is rotated to the "FIRE" position, the recess 23 is positioned to allow free movement of the firing mechanism.

As shown, the lock member 12 has a projection 26 formed in each end of the lock member 12 and the lever members 10 and 30 are formed with recesses 28, which mate with the projections 26 to ensure that the lock member 12 is rotated with the lever member 10 or 30.

A detent recess 27 is formed in a portion of the lock member 12. The recess 27 is capable of interacting with a detent of the firearm to limit rotational movement of the safety selector 5.

Prior art safety selector levers have been attached solely by screws. However, repeated movement of the safety selector levers applies torque and sheering forces to the screws, which tends to strip the screws, allowing the safety selector lever to detach or fall off, rendering the safety inoperable and useless. The recessed design of the present invention provides a very solid attachment in which the screws 18 simply prevent the levers 10 and 30 from sliding along the recesses 28 and are subject to no additional stress as the levers 10 and 30 are rotated.

As issued, the safety selector 5 has a lever member, such as lever member 10, located only on the left side of the firearm, which is inconvenient for left-handed shooters. Also, the standard lever member is approximately 1 inch in length and approximately ¼ inch in thickness. Unfortunately, this thickness can bear against the shooter's flesh and can be quite uncomfortable. Also, this length makes it quite easy for the lever member to snag the web of skin between the shooter's thumb and forefinger, which is extremely painful and, under combat conditions, can easily become infected, which can lead to serious or even fatal consequences. On the other hand, some shooters prefer a lever member of this length as being easy to locate and rotate.

To overcome these difficulties, the present invention provides lever members on each side of the firearm, such as levers 10 and 30, as illustrated in FIG. 1. This makes the safety selector 5 conveniently operable by both right- and left-handed shooters.

Furthermore, as illustrated in FIGS. 9-25, the present invention provides a plurality of interchangeable lever members 10, 20, 30, 40, 50, 60, 70, and 80 of different lengths, thicknesses, and configurations to allow the shooter to select lever members that are most satisfactory to the shooter.

Figure 4:
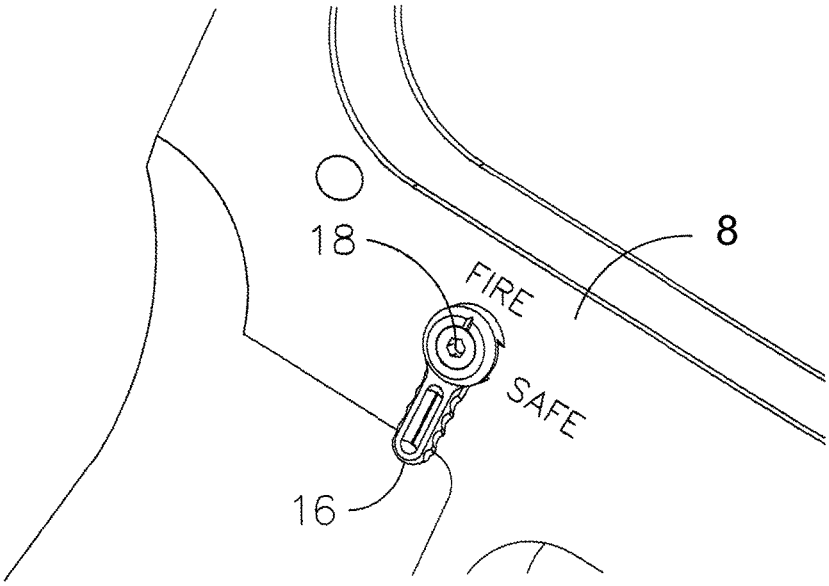
FIG. 4 illustrates a side view of an alternative form of the safety selector of FIG. 3.
Figure 14:
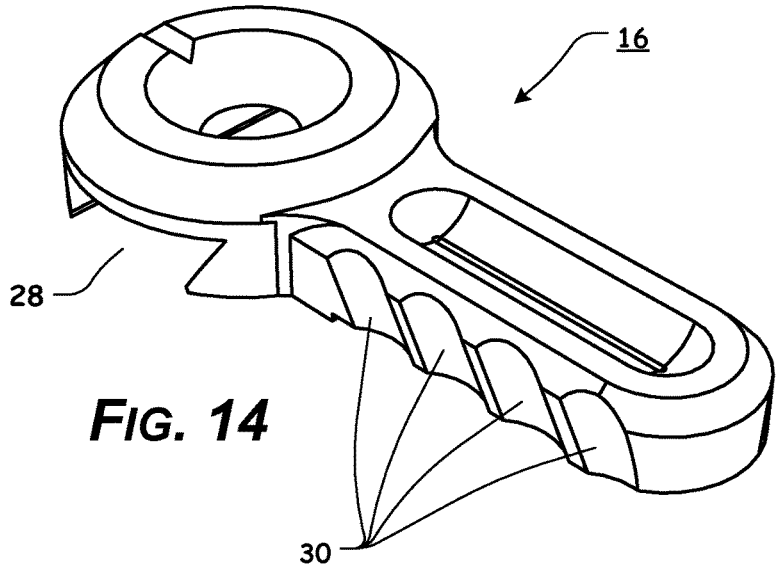
FIG. 14 illustrates a rear perspective view of the exemplary safety selector lever member of FIG. 4.
Figure 15:
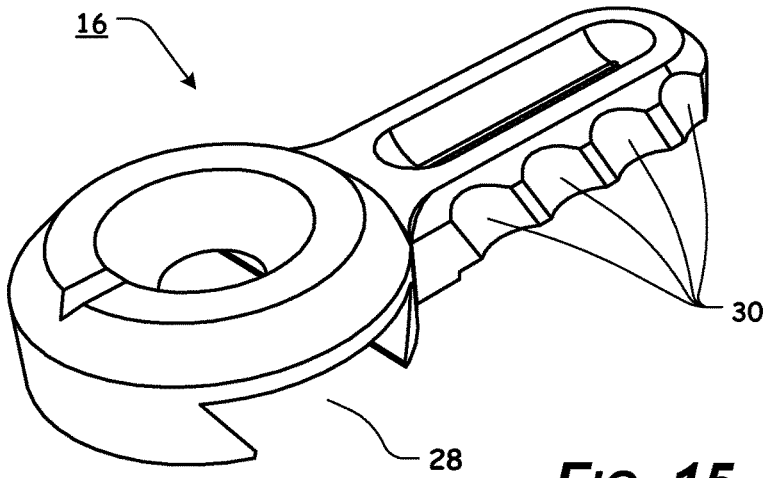
FIG. 15 illustrates a front perspective view of the exemplary safety selector lever member of FIG. 4.

For example, FIGS. 4, 14, and 15 show a lever member 30, which has a thickness of only approximately ⅛ inch. This thinner lever member is much more comfortable when underlying the shooter's skin and yet is equally easy to locate to arm or disarm the firearm.

Figure 5:
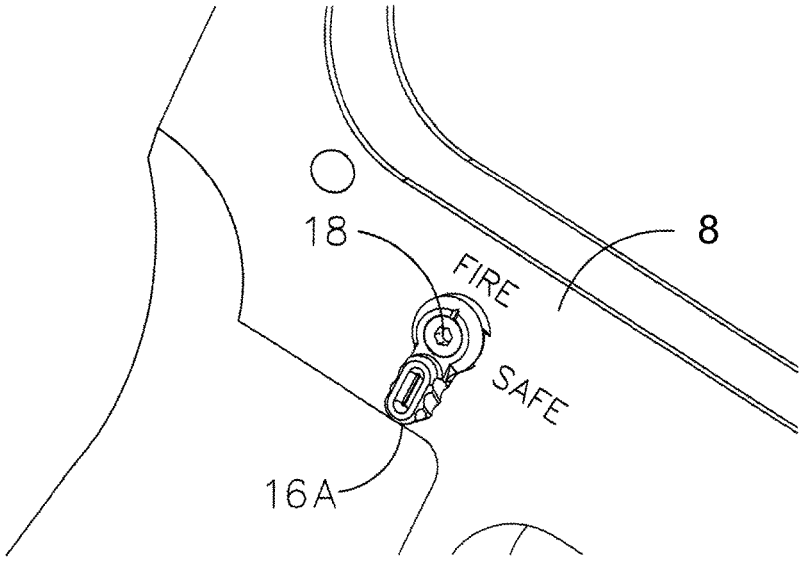
FIG. 5 illustrates a side view of another alternative form of the safety selector of FIG. 3.
Figure 6:
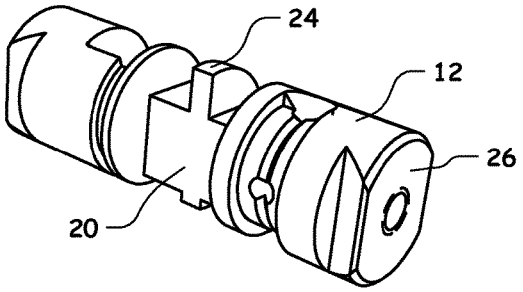
FIG. 6 illustrates an alternate view of the lock member of FIG. 1.
Figure 7:
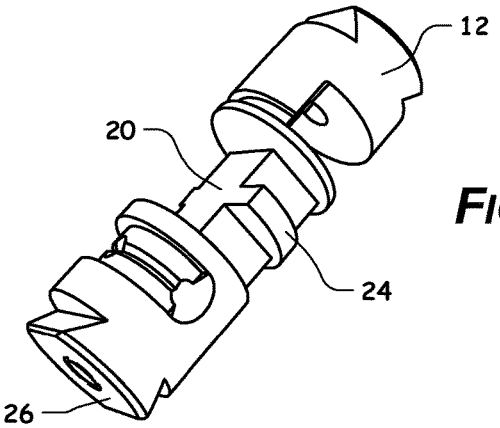
FIG. 7 illustrates another alternative perspective view of the lock member of FIG. 1.
Figure 8:
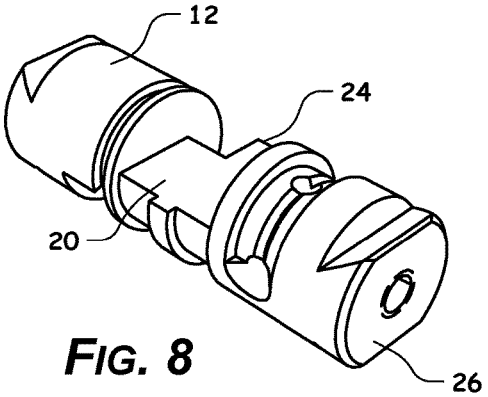
FIG. 8 illustrates a perspective view of the lock member of FIG. 1.
Figure 9:
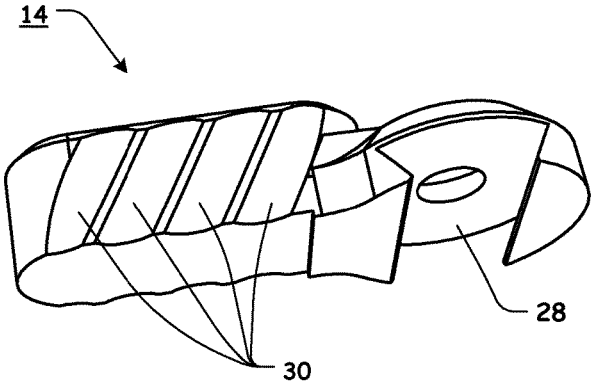
FIG. 9 illustrates a bottom perspective view of the first exemplary safety selector lever member of FIGS. 1-3.
Figure 10:
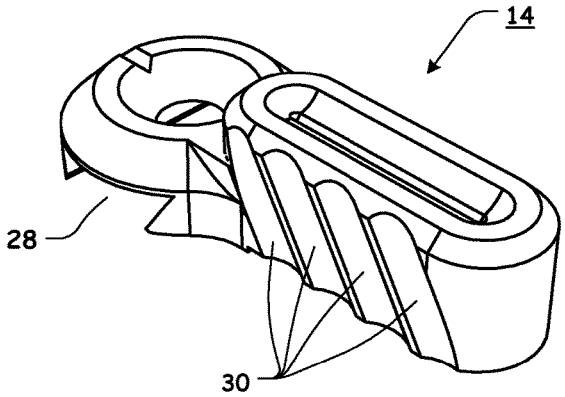
FIG. 10 illustrates a rear perspective view of the first exemplary safety selector lever member of FIGS. 1-3.
Figure 11:
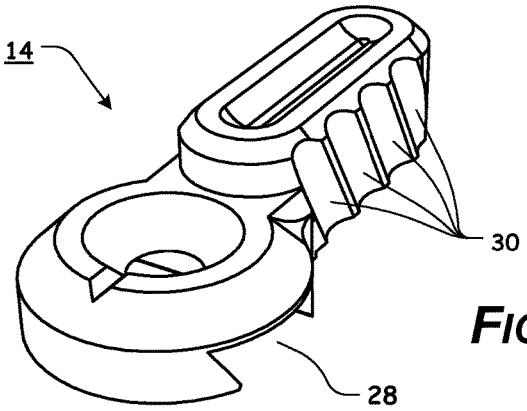
FIG. 11 illustrates a front perspective view of the first exemplary safety selector lever member of FIGS. 1-3.
Figure 12:
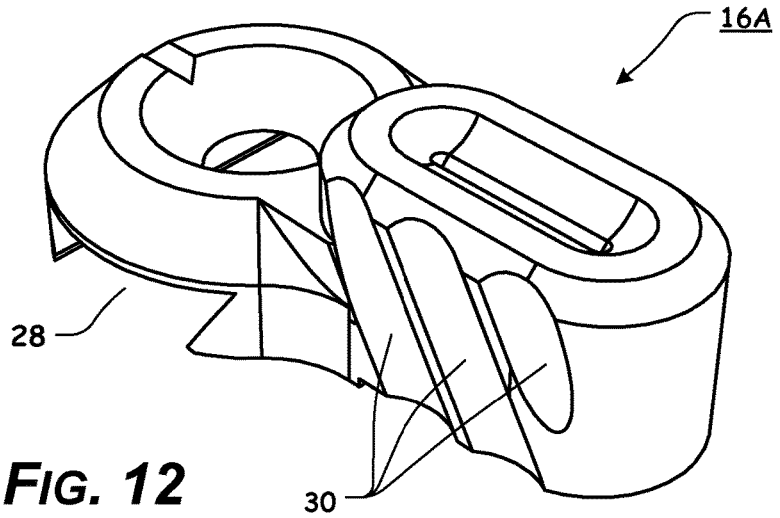
FIG. 12 illustrates a rear perspective view of the exemplary safety selector lever member of FIGS. 1 and 5.
Figure 13:
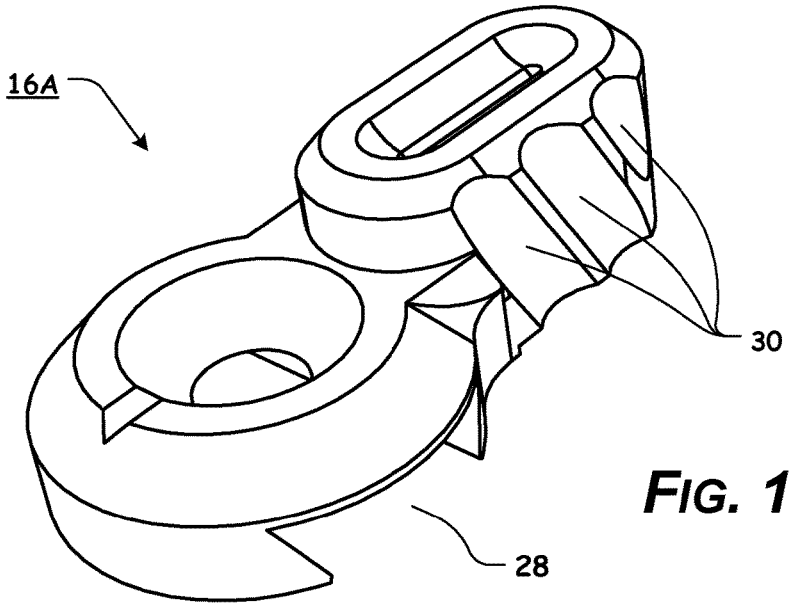
FIG. 13 illustrates a front perspective view of the exemplary safety selector lever member of FIGS. 1 and 5.

FIGS. 5, 12, and 13 show a lever member 20, which is only approximately ½ inch in length. This significantly reduces the likelihood of snagging the shooter's skin, which avoids the hazards associated with this problem.

Figure 16:
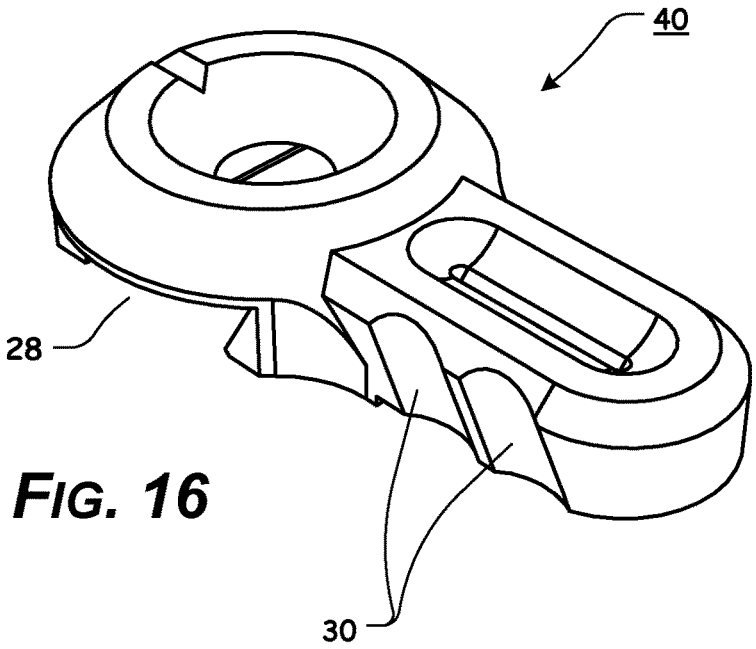
FIG. 16 illustrates a rear perspective view of a fourth alternate exemplary safety selector lever member of the present invention.
Figure 17:
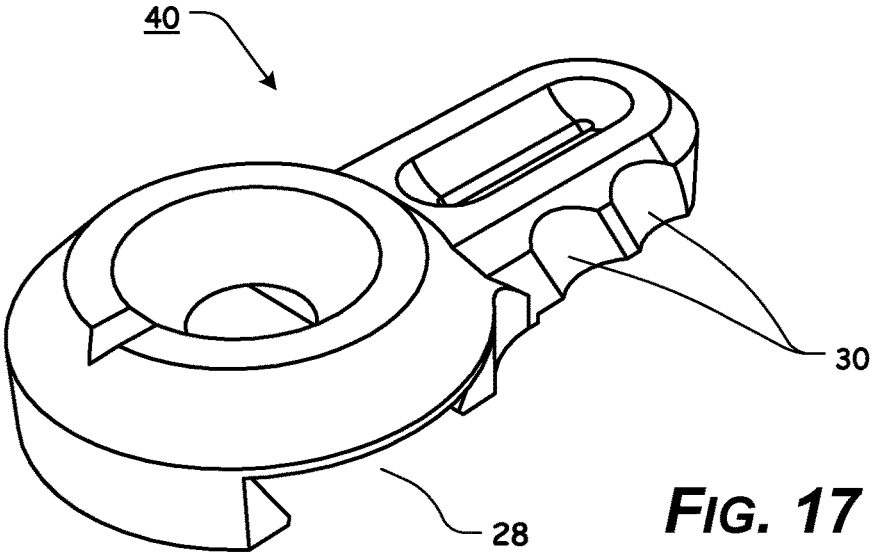
FIG. 17 illustrates a front perspective view of the fourth alternate exemplary safety selector lever member of FIG. 16.

FIGS. 16 and 17 show a lever member 40, which combines certain of the features of the lever member 20 and the lever member 30, Bye having a sickness of only approximately ⅛ inch and a length of only approximately ½ inch.

Figure 18:
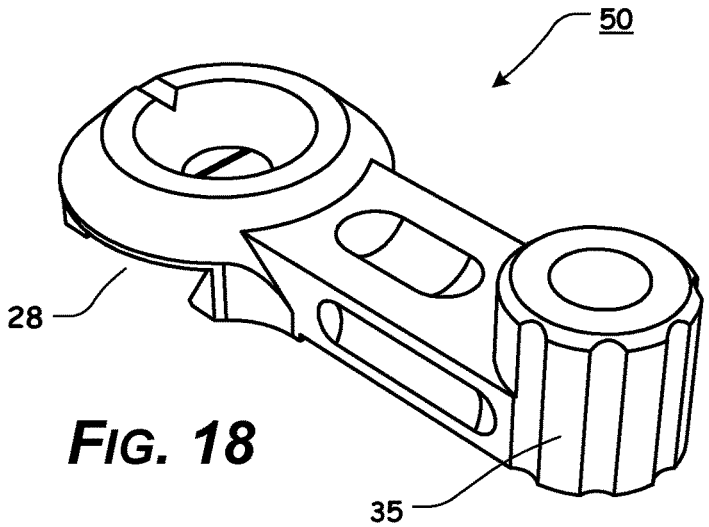
FIG. 18 illustrates a rear perspective view of a fifth alternate exemplary safety selector lever member of the present invention.
Figure 19:
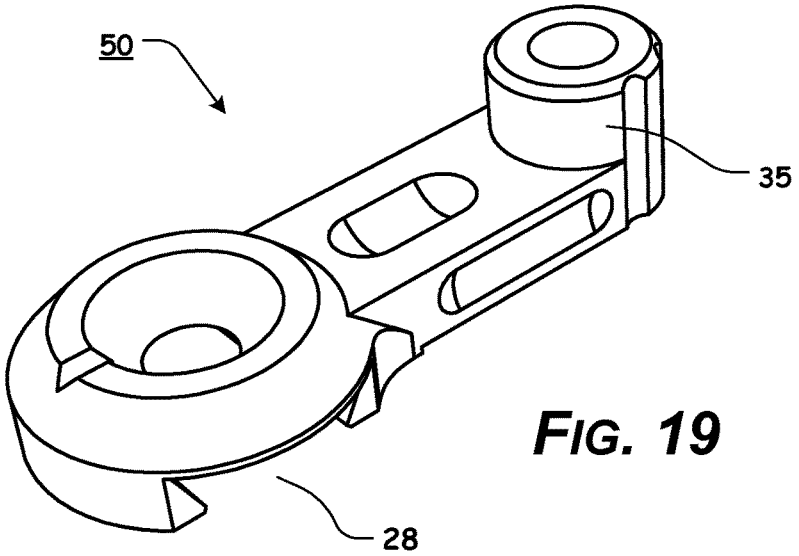
FIG. 19 illustrates a front perspective view of the fifth alternate exemplary safety selector lever member of FIG. 18.

FIGS. 18 and 19 show a lever member 50, which includes a protrusion or crank 35 that is spaced some distance from the recess 28.

Figure 20:
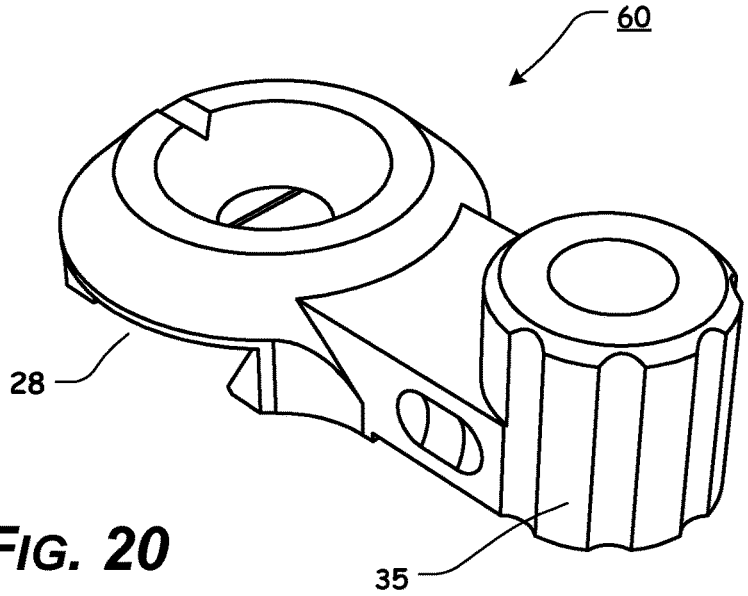
FIG. 20 illustrates a rear perspective view of a sixth alternate exemplary safety selector lever member of the present invention.
Figure 21:
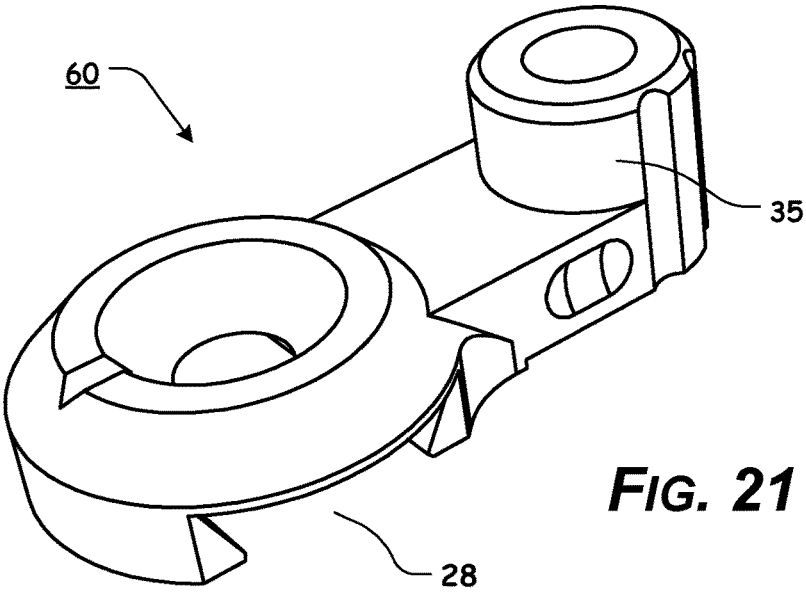
FIG. 21 illustrates a front perspective view of the sixth alternate exemplary safety selector lever member of FIG. 20.

FIGS. 20 and 21 show a lever member 60, which includes a protrusion or crank 35, similar to that of lever member 50. However, the protrusion or crank 35 of lever member 60 is spaced a shorter distance from the recess 28 than the protrusion or crank 35 of lever member 50.

Figure 22:
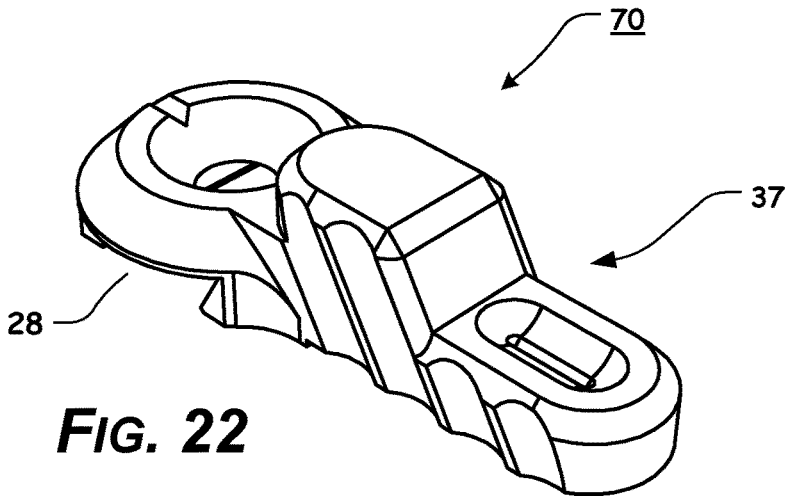
FIG. 22 illustrates a rear perspective view of a seventh alternate exemplary safety selector lever member of the present invention.
Figure 23:
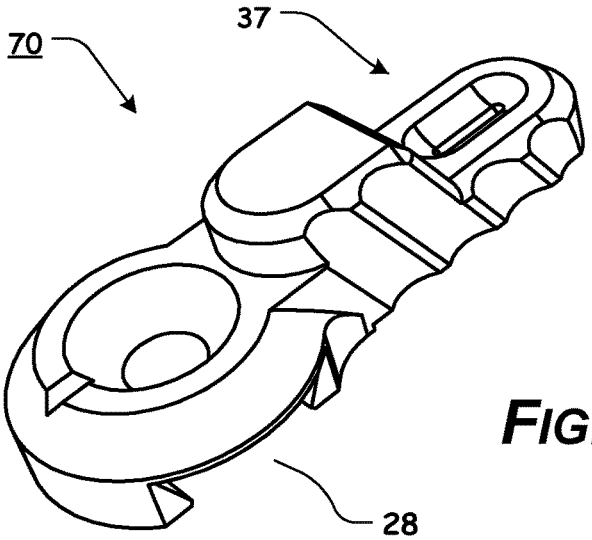
FIG. 23 illustrates a front perspective view of the seventh alternate exemplary safety selector lever member of FIG. 22.

FIGS. 22 and 23 show a lever member 70, which includes a notch or recess 37 formed proximate a terminal end of the lever member 70.

Figure 24:
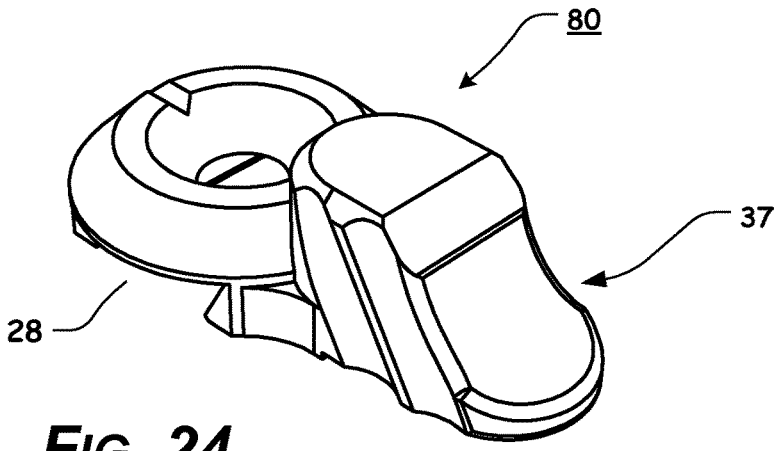
FIG. 24 illustrates a rear perspective view of an eighth alternate exemplary safety selector lever member of the present invention.
Figure 25:
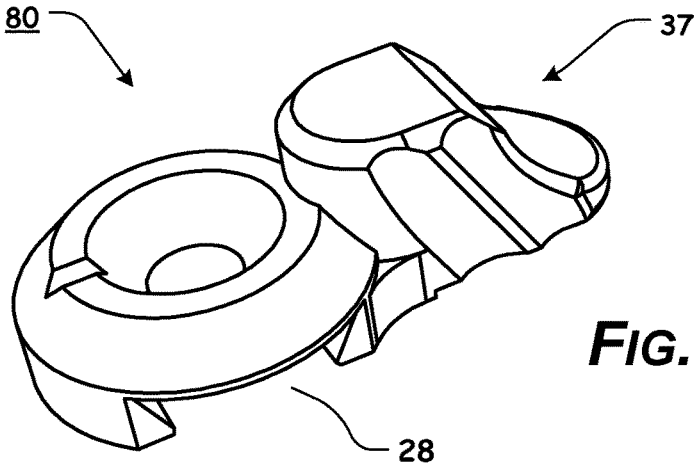
FIG. 25 illustrates a front perspective view of the eighth alternate exemplary safety selector lever member of FIG. 24.

FIGS. 24 and 25 show a lever member 80. The lever member 80 includes a notch or recess 38 formed proximate a terminal end of the lever member 80. When compared to lever member 70, the lever member 80 is shorter in overall length and the notch or recess 38 is more sloped or scalloped, when compared to the notch or recess 37.

As noted above, the lever members 10, 20, 30, 40, 50, 60, 70, and 80 are interchangeable and may be mounted on each end of the lock member 12. Furthermore, the lever member 10, 20, 30, 40, 50, 60, 70, or 80 on one end of the lock member 12 may or may not match the lever member 10, 20, 30, 40, 50, 60, 70, or 80 on the opposite end of the lock member 12.

It should also be noted that the lever members 10, 20, 30, 40, 50, 60, 70, and 80 are formed with a plurality of diagonal grooves 30 and/or vertical grooves 31. These grooves serve to prevent the user's finger from slipping off the lever members 10, 20, 30, 40, 50, 60, 70, and 80 and also serve to hold paint, which may be applied to the lever members 10, 20, 30, 40, 50, 60, 70, and 80 as is often done in training.

In various exemplary embodiments, various components of the interchangeable safety selector 5 are substantially rigid and are formed of stainless steel. Alternate materials of construction of the various components of the interchangeable safety selector 5 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the interchangeable safety selector 5 is a design choice based on the desired appearance and functionality of the interchangeable safety selector 5.

It should be appreciated that certain elements of the interchangeable safety selector 5 may be formed as an integral unit (such as, for example, the lock member 12 and one or more of the lever members 10, 20, 30, 40, 50, 60, 70, or 80). Alternatively, suitable materials can be used and sections or elements made independently and attached or coupled together, such as by adhesives, welding, screws, rivets, pins, or other fasteners, to form the various elements of the interchangeable safety selector 5.

It should also be understood that the overall size and shape of the interchangeable safety selector 5 and the various portions thereof, the lock member 12, and the lever members 10, 20, 30, 40, 50, 60, 70, or 80, is a design choice based upon the desired functionality and/or appearance of the interchangeable safety selector 5.

Figure 26:
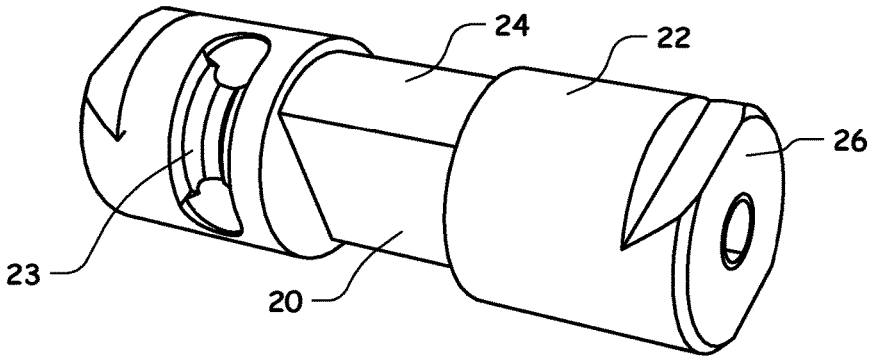
FIG. 26 illustrates a perspective view of a second alternate exemplary lock member of the present invention.

FIGS. 26, 27, 28, 30, and 31 show alternative embodiments of the lock member 12. As illustrated in FIG. 26, is the lock member 22 includes features similar to the lock member 12, but includes alternately formed central recess 23 and first portion 24. It should be appreciated that the formation of the central recess 23 and the first portion 24 allow the lock member to interact with different portions of the firearm's trigger mechanism at different points along the rotation of the lock member, thereby potentially providing, for example, a "SAFE" position, a semi-auto "FIRE" position, a burst "FIRE" position, and/or a full-auto "FIRE" position.

As further illustrated in FIG. 26, the detent recess 27 is formed to provide 90° of rotational movement of the lock member 22.

Figure 27:
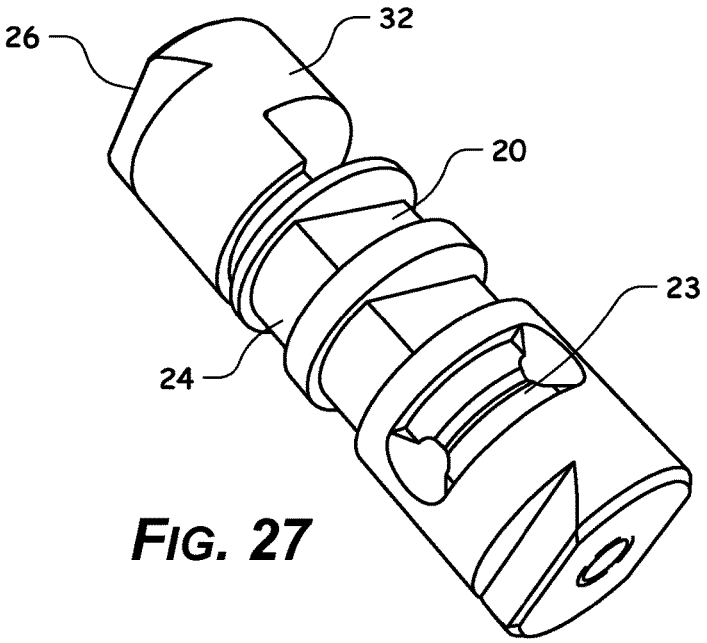
FIG. 27 illustrates a perspective view of a third alternate exemplary lock member of the present invention.

FIG. 27 illustrates an exemplary lock member 32. The lock member 32 includes features similar to the lock members 12 and 22, but includes alternately formed central recess 23 and first portion 24.

Figure 28:
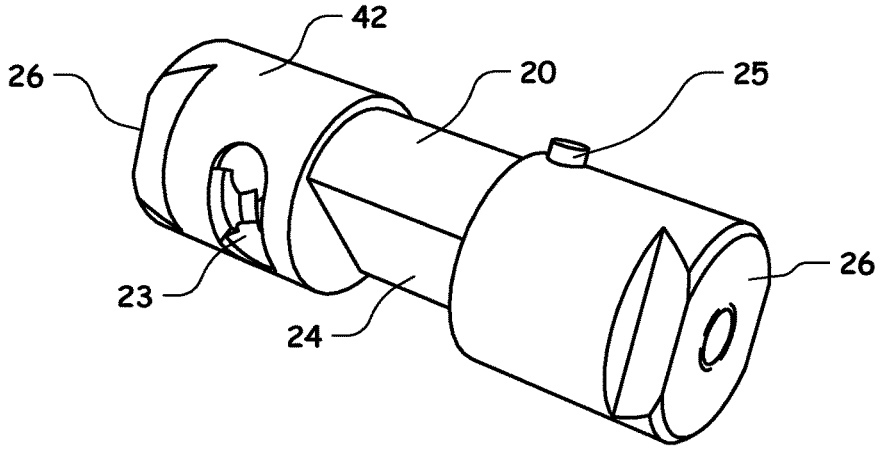
FIG. 28 illustrates a perspective view of a fourth alternate exemplary lock member of the present invention.

FIG. 28 illustrates an exemplary lock member 42. The lock member 42 includes features similar to the lock member 22, but includes a pin or projection 25 that can allow the lock member 42 to only be used with certain firearms having an appropriate keyway to allow the lock member 42, having the projection 25, to be installed in the firearm.

Figure 29:
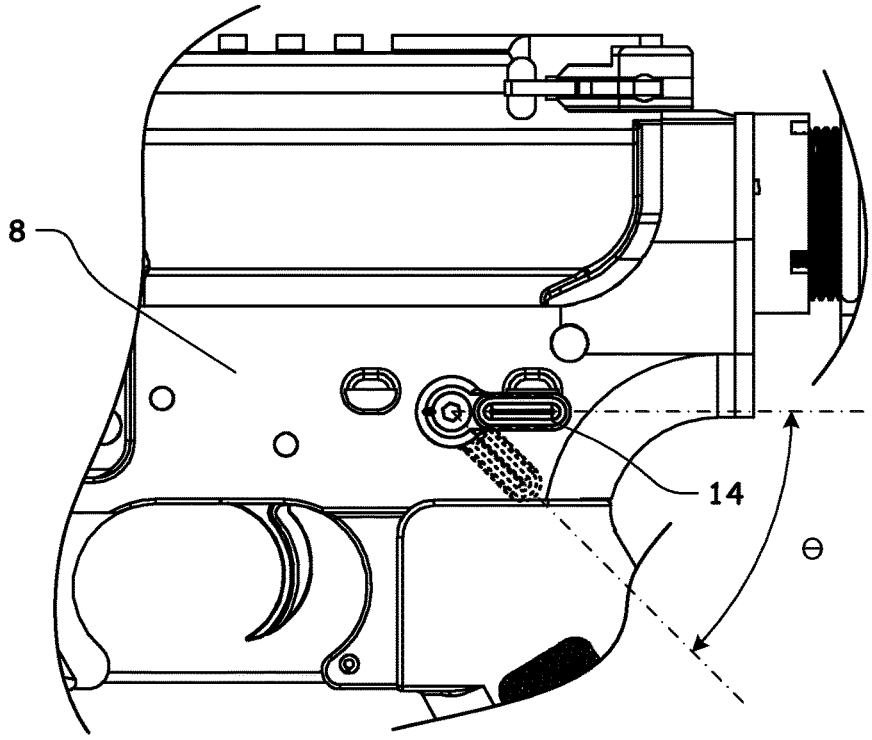
FIG. 29 illustrates a side view of a portion of an exemplary AR-15 or M4 style firearm showing an exemplary safety selector used with the lock member of FIG. 28, illustrating the exemplary safety selector in the "SAFE" position and the "FIRE" position.

Furthermore, the detent recess 27 formed in the lock member 42 is formed so as to provide 50° of rotational movement of the lock member 42, with detented stop points at 0° and 50°. Thus, utilizing the lock member 42, a lever member, such as, for example lever member 10, as illustrated in FIG. 29, is only rotated 50° (θ) to move from the "SAFE" position to the "FIRE" position.

It should be appreciated that by altering the length of the detent recess 27, the degree of rotation (θ) for the lever member can be altered.

Figure 30:
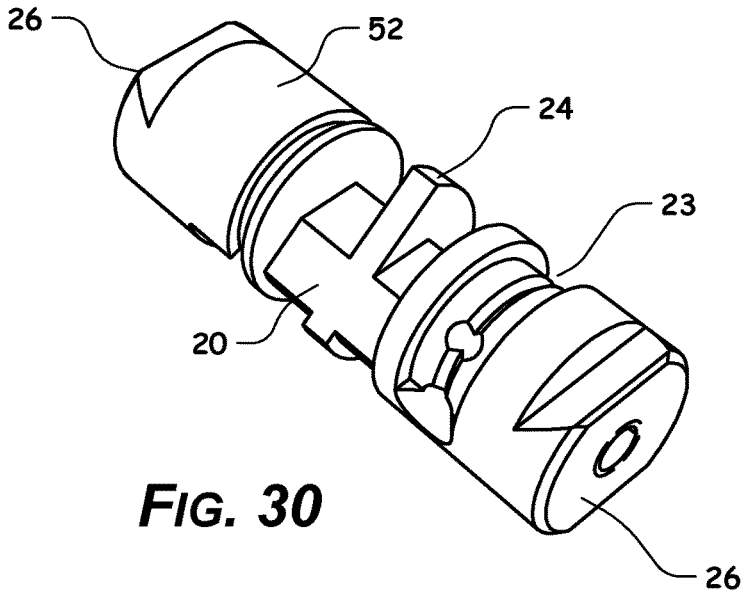
FIG. 30 illustrates a first perspective view of a fifth alternate exemplary lock member of the present invention.
Figure 31:
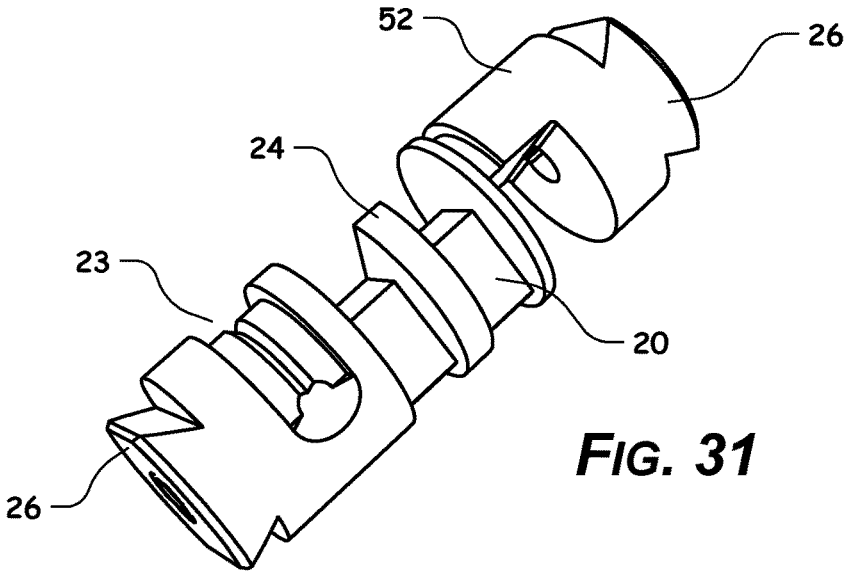
FIG. 31 illustrates a second perspective view of the fifth alternate exemplary lock member of FIG. 30.

FIGS. 30 and 31 show alternate views of a lock member 52. As illustrated, the detent recess 27 provides for 180° of rotation, with detented stop points at 0°, 50°, and 180°.

Figure 32:
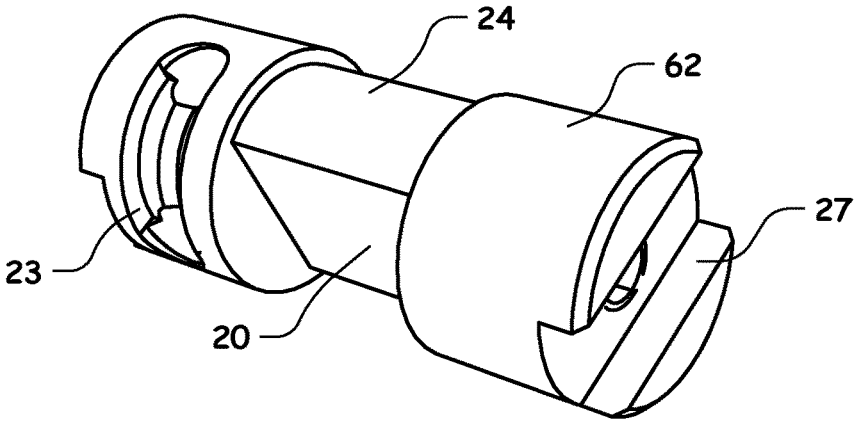
FIG. 32 illustrates a perspective view of a sixth alternate exemplary lock member of the present invention.
Figure 33:
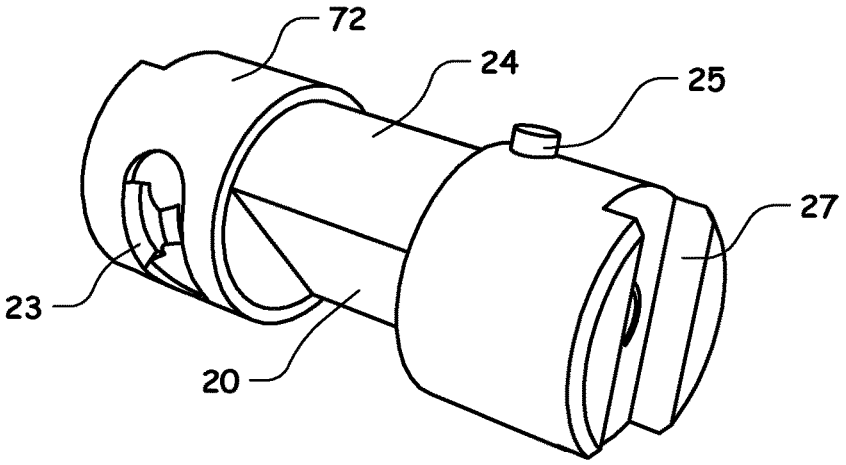
FIG. 33 illustrates a perspective view of a seventh alternate exemplary lock member of the present invention.
Figure 34:
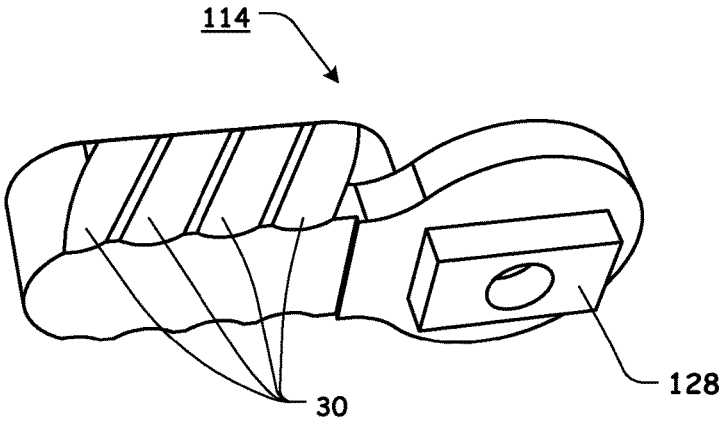
FIG. 34 illustrates a bottom perspective view of an alternate exemplary safety selector lever member according to this invention.
Figure 35:
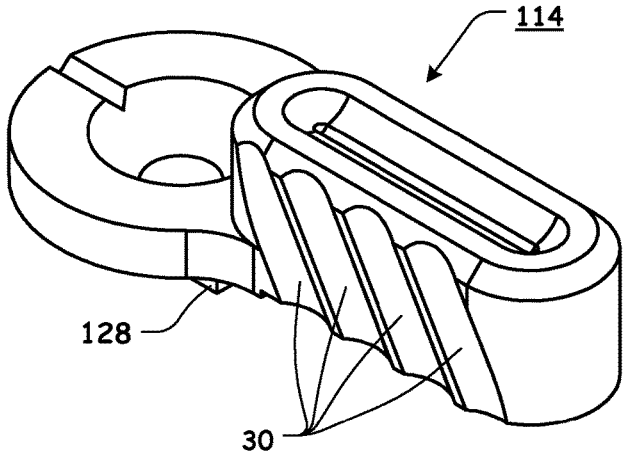
FIG. 35 illustrates a rear perspective view of the alternate exemplary safety selector lever member of FIG. 34.
Figure 36:
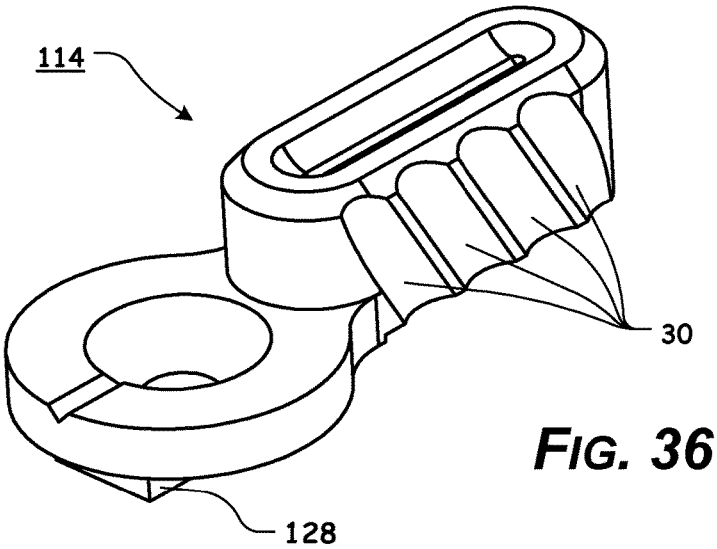
FIG. 36 illustrates a front perspective view of the alternate exemplary safety selector lever member of FIG. 34.
Figure 37:
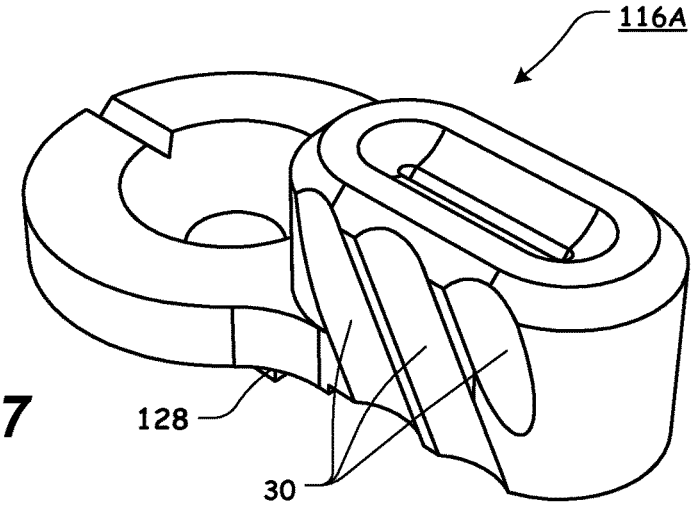
FIG. 37 illustrates a rear perspective view of a ninth alternate exemplary safety selector lever member of the present invention.
Figure 38:
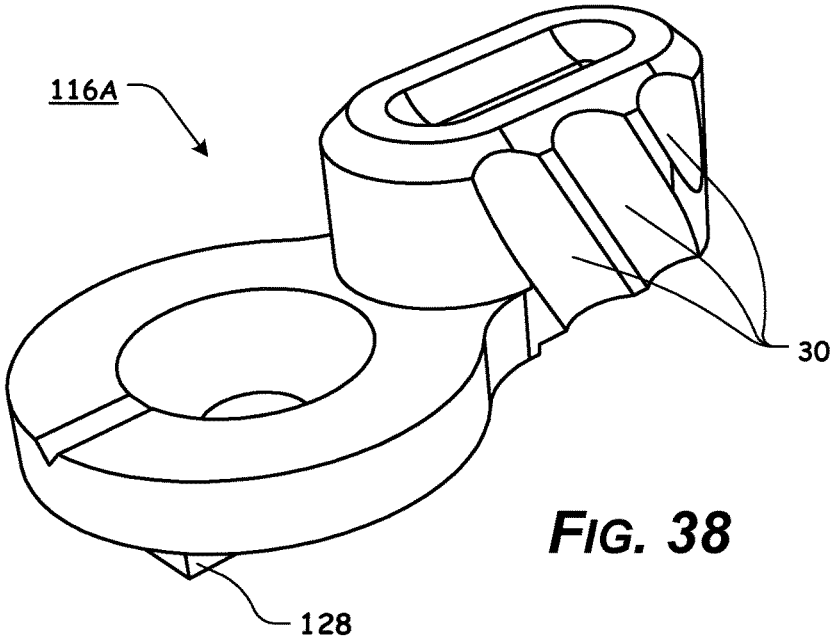
FIG. 38 illustrates a front perspective view of the ninth alternate exemplary safety selector lever member of FIG. 37.
Figure 39:
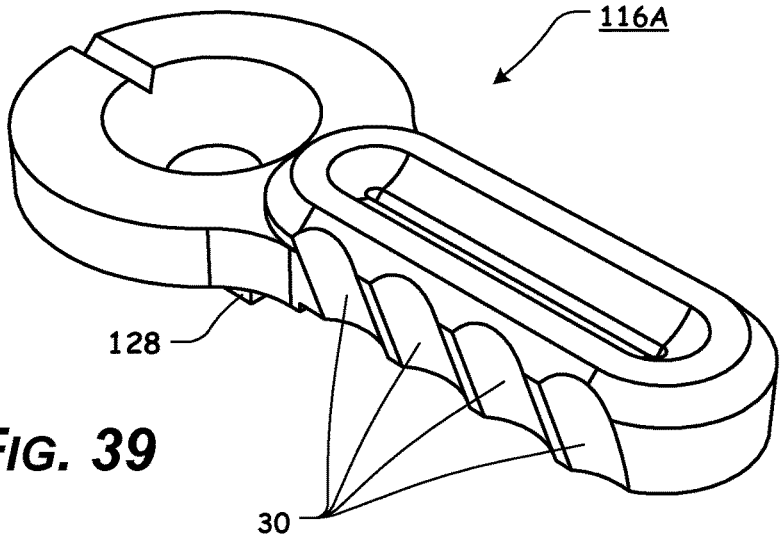
FIG. 39 illustrates a rear perspective view of a tenth alternate exemplary safety selector lever member of the present invention.
Figure 40:
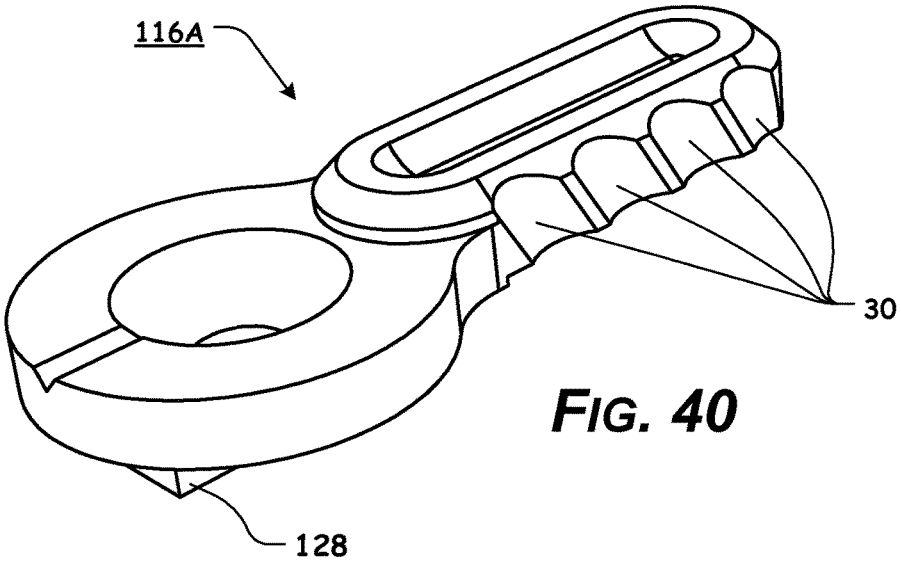
FIG. 40 illustrates a front perspective view of the tenth alternate exemplary safety selector lever member of FIG. 39.
Figure 41:
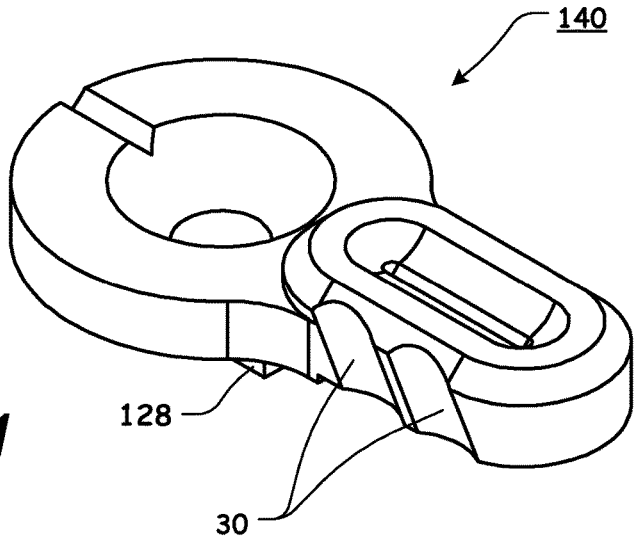
FIG. 41 illustrates a rear perspective view of an eleventh alternate exemplary safety selector lever member of the present invention.
Figure 42:
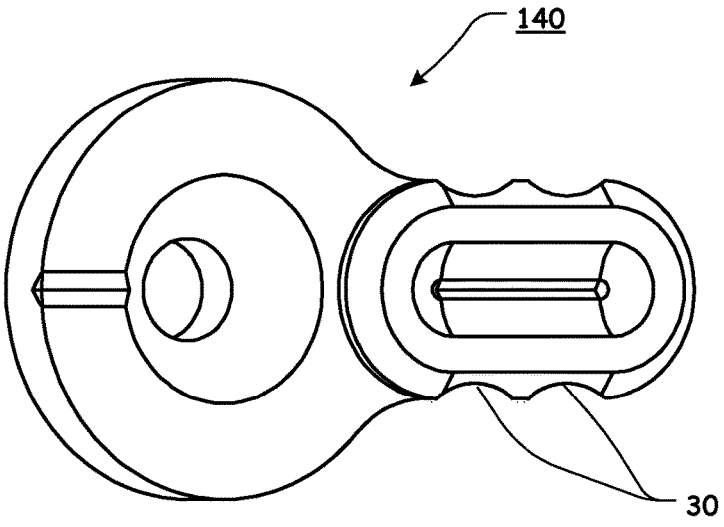
FIG. 42 illustrates a front perspective view of the eleventh alternate exemplary safety selector lever member of FIG. 41.
Figure 43:
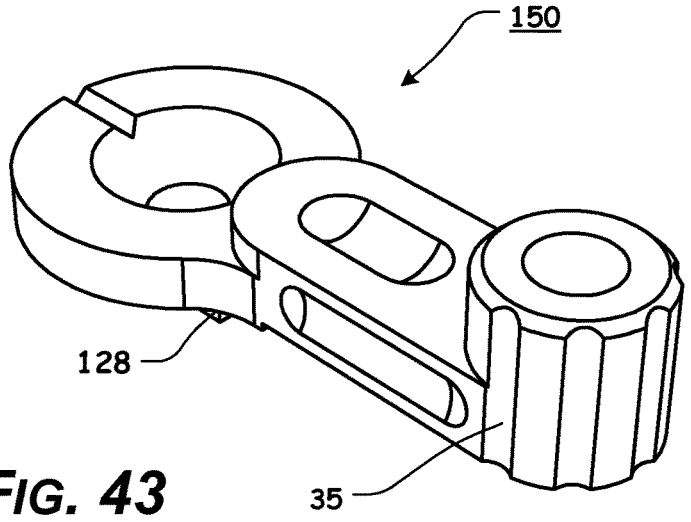
FIG. 43 illustrates a rear perspective view of a twelfth alternate exemplary safety selector lever member of the present invention.
Figure 44:
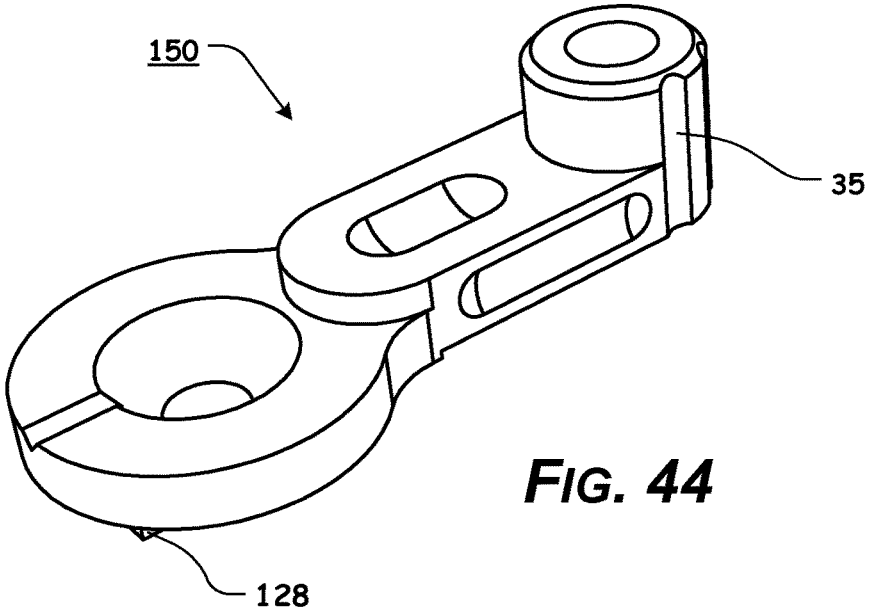
FIG. 44 illustrates a front perspective view of the twelfth alternate exemplary safety selector lever member of FIG. 43.
Figure 45:
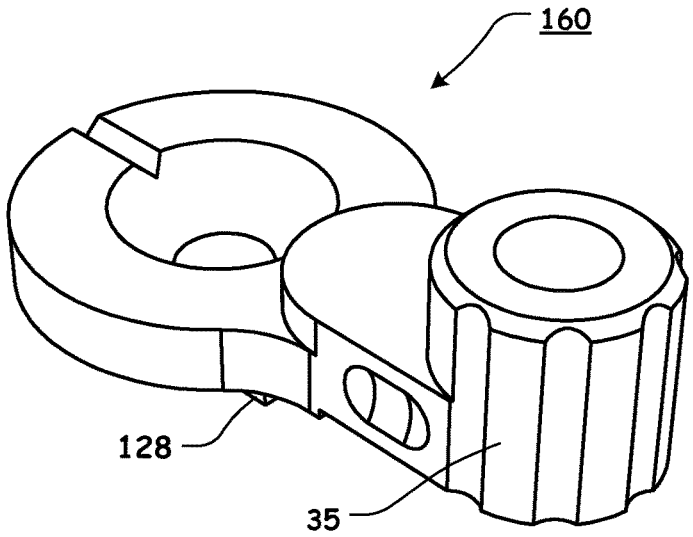
FIG. 45 illustrates a rear perspective view of a thirteenth alternate exemplary safety selector lever member of the present invention.
Figure 46:
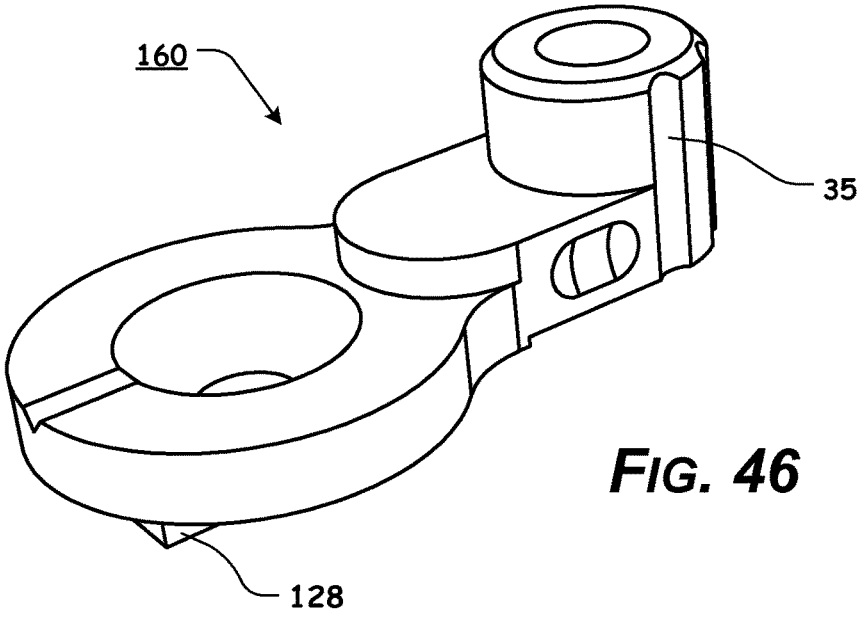
FIG. 46 illustrates a front perspective view of the thirteenth alternate exemplary safety selector lever member of FIG. 45.
Figure 47:
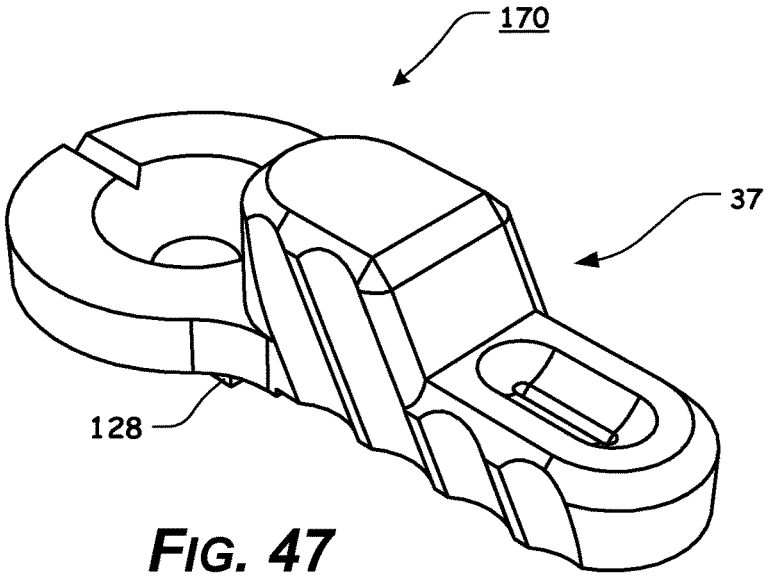
FIG. 47 illustrates a rear perspective view of a fourteenth alternate exemplary safety selector lever member of the present invention.
Figure 48:
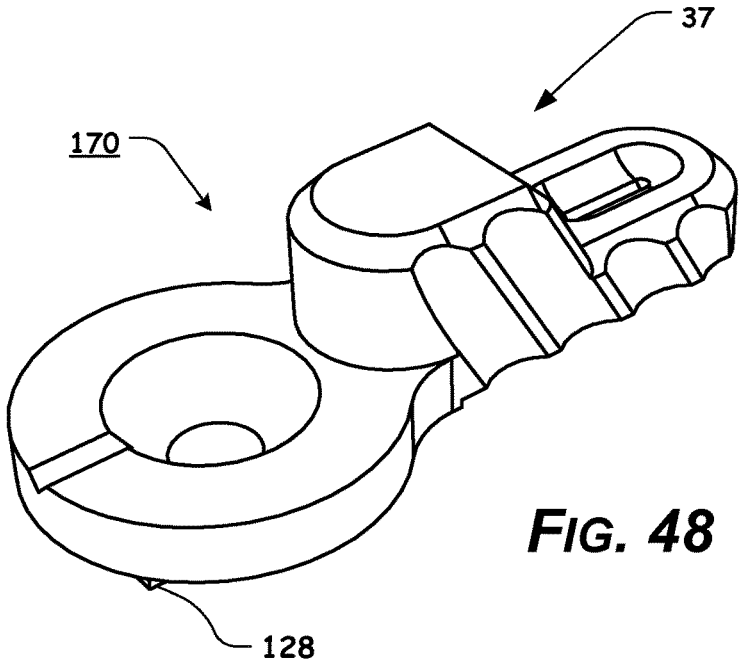
FIG. 48 illustrates a front perspective view of the fourteenth alternate exemplary safety selector lever member of FIG. 47.
Figure 49:
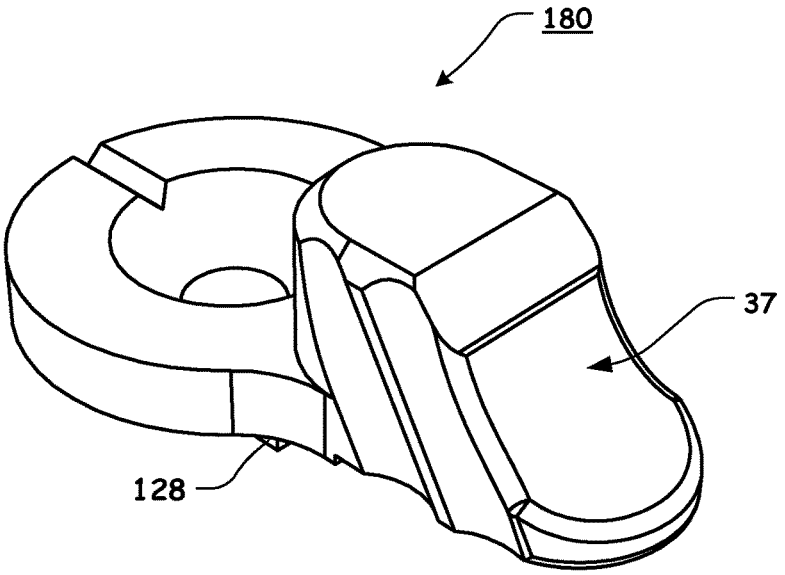
FIG. 49 illustrates a rear perspective view of a fifteenth alternate exemplary safety selector lever member of the present invention.
Figure 50:
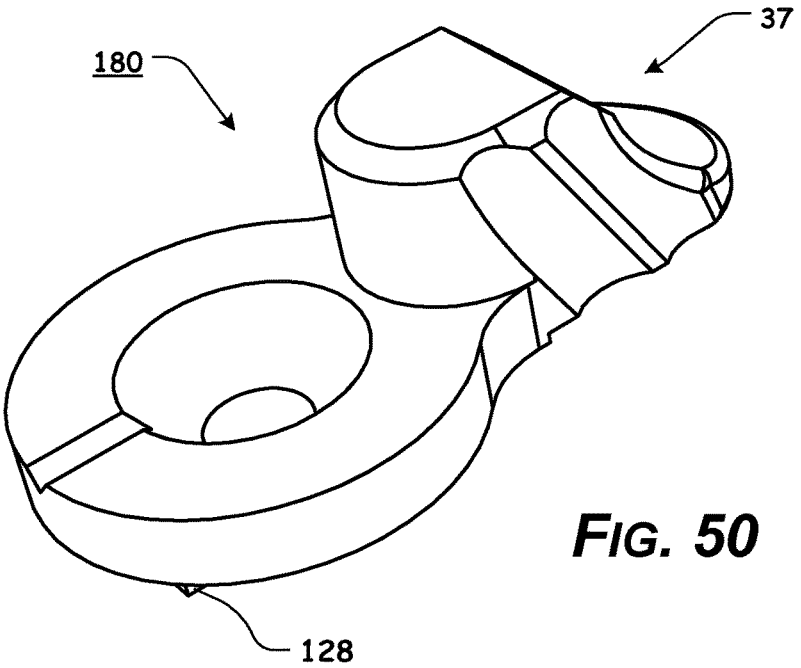
FIG. 50 illustrates a front perspective view of the fifteenth alternate exemplary safety selector lever member of FIG. 49.

FIGS. 32 and 33 show alternate embodiments of a lock member 62 and 72. The lock members 62 and 72 include at least some a central recess 23, a first portion 24, a detent recess 27, and a pin or projection 25. It should be appreciated that these elements correspond to and operate similarly to the central recess 23, the first portion 24, the detent recess 27, and the pin or projection 25, as described, with reference to lock members 12-52.

However, as illustrated in FIGS. 32 and 33, the lock members 62 and 72 include projections 29 instead of projections 26. As shown, the lock members 62 and 72 have a projection 29 formed in each end of the lock members 62 and 72 (defining a recess 29') and the lever members 110, 120, 130, 140, 150, 160, 170, and 180 each include a projection 128, which mates with the projections 29 and recess 29' to ensure that the lock member 62 or 72 is rotated with the lever member 110, 120, 130, 140, 150, 160, 170, or 180.

It should be appreciated that the characteristics of the lever members 110, 120, 130, 140, 150, 160, 170, and 180 correspond to the characteristics of the lever members 10, 20, 30, 40, 50, 60, 70, and 80, respectively.

It should also be appreciated that a more detailed explanation of the specific dimensions of certain components of the interchangeable safety selector 5, instructions regarding how to install the interchangeable safety selector 5, methods for using the interchangeable safety selector 5, once installed, and certain other items and/or techniques necessary for the implementation and/or operation of the various exemplary embodiments of the present invention are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An interchangeable safety selector, comprising:

a generally cylindrical lock member rotatable between at least a safe and at least one fire position, wherein when said lock member is in said safe position at least a portion of said lock member blocks movement of at least a portion of a firing mechanism of a firearm;

a dovetail projection formed on each end of said lock member; and at least two lever members, each lever member having a recess mateable with said projection of said lock member, wherein said recess extends through opposing sides of said lever members, wherein said lever members are interchangeable, wherein one of said lever members is secured to a first end of said lock member via interaction of said projection and said recess.

2. The interchangeable safety selector of claim 1, further comprising a detent recess formed in said lock member, wherein said detent recess restricts rotational movement of said lock member to 50°.

3. The interchangeable safety selector of claim 2, further comprising at least two detented stop points formed in said detent recess to provide detented stop points at 0° and 50° of rotation.

4. The interchangeable safety selector of claim 1, wherein each of said projections is selectably rotatable to allow rotatable movement of said cylindrical lock member.

5. The interchangeable safety selector of claim 1, wherein when said lock member is in said fire position said lock member does not block movement of said firing mechanism of said firearm.

6. The interchangeable safety selector of claim 1, wherein said lever members are approximately 1 inch in length and approximately ¼ inch in thickness.

7. The interchangeable safety selector of claim 1, wherein said lever members are approximately ⅛ inch in thickness.

8. The interchangeable safety selector of claim 1, wherein said lever members are approximately ½ inch in length.

9. The interchangeable safety selector of claim 1, wherein a plurality of said lever members are provided.

10. The interchangeable safety selector of claim 1, wherein said lever members are attached to both ends of said lock member.

11. The interchangeable safety selector of claim 1, wherein said lever members are of different lengths.

12. The interchangeable safety selector of claim 1, wherein said lever members are of different thicknesses.

13. The interchangeable safety selector of claim 1, wherein said lever members include different lengths and thicknesses.

14. The interchangeable safety selector of claim 1, wherein one of said lever members is secured to a second end of said lock member via interaction of said projection and said recess and is further secured to said second end of said lock member via a screw.

15. The interchangeable safety selector of claim 1, wherein said recess in said lever member is dovetailed.

16. The interchangeable safety selector of claim 1, wherein said lever member is formed with a plurality of diagonal grooves.

17. The interchangeable safety selector of claim 1, wherein said lock member comprises at least one central recess formed proximate a central portion of said lock member and wherein said central recess includes at least one substantially planar portion positioned to allow movement of said firing mechanism when said lock member is rotated to a "FIRE" position.

18. An interchangeable safety selector, comprising:

a substantially cylindrical lock member rotatable between at least a safe and at least one a fire position, wherein when said lock member is in said safe position, at least a portion of said lock member blocks movement of a portion of a firing mechanism of a firearm;

a dovetail projection formed proximate each end of said lock member; and at least two lever members, each lever member having a recess mateable with said dovetail projection of said lock member, wherein said recess extends through opposing side portions of said lever members, and wherein one of said lever members is secured to a first end of said lock member via interaction of said dovetail projection and said recess.

* * * * *